US010730729B1

(12) United States Patent
Cui et al.

(10) Patent No.: US 10,730,729 B1
(45) Date of Patent: Aug. 4, 2020

(54) SCISSOR-LIFT

(71) Applicants: Kan Cui, Mercer Island, WA (US); Margaret C. Liu, Mercer Island, WA (US); Samuel K. Liu, Mercer Island, WA (US)

(72) Inventors: Kan Cui, Mercer Island, WA (US); Margaret C. Liu, Mercer Island, WA (US); Samuel K. Liu, Mercer Island, WA (US)

( * ) Notice: Subject to any disclaimer, the term of this patent is extended or adjusted under 35 U.S.C. 154(b) by 0 days.

(21) Appl. No.: 16/802,546

(22) Filed: Feb. 26, 2020

(51) Int. Cl.

| | |
|---|---|
| ***B66F 11/04*** | (2006.01) |
| ***B66F 7/06*** | (2006.01) |
| ***E04G 1/34*** | (2006.01) |
| ***B66F 3/22*** | (2006.01) |

(52) U.S. Cl.
CPC ..... *B66F 11/042* (2013.01); *B66F 3/22* (2013.01); *B66F 7/0625* (2013.01); *B66F 7/0658* (2013.01); *B66F 7/0666* (2013.01); *E04G 1/34* (2013.01)

(58) Field of Classification Search
CPC .... B66F 11/042; B66F 7/0658; B66F 7/0666; B66F 3/22; E04G 1/34
See application file for complete search history.

(56) References Cited

U.S. PATENT DOCUMENTS 931,702 A 8/1909 Otter
999,126 A * 7/1911 Sistermann ..... B66F 11/042 182/69.5
1,018,338 A * 2/1912 Pines ..... B66F 11/042 182/69.5
1,498,813 A * 6/1924 Sankela et al. ..... B66F 3/22 187/269
2,370,887 A * 3/1945 Soskin ..... A62B 1/02 182/101
2,554,494 A * 5/1951 Hodgin ..... B66F 7/0666 254/122
2,697,845 A * 12/1954 Broner ..... E04H 12/185 14/45
2,975,868 A * 3/1961 Long ..... B66F 3/22 187/269
2,978,754 A * 4/1961 Wilson ..... E04H 3/28 108/170

(Continued)

FOREIGN PATENT DOCUMENTS

CN 110259095 A 9/2019
DE 918112 C * 9/1954 ..... B66F 11/042

(Continued)

*Primary Examiner* — Colleen M Chavchavadze
(74) *Attorney, Agent, or Firm* — Richard C. Litman; Nath, Goldberg & Meyer

(57) ABSTRACT

The scissor lift includes a horizontally collapsible base, a vertically collapsible frame mounted on the base, a horizontally foldable platform mounted on top of the vertically collapsible frame, and a plurality of wheels mounted on the base. The horizontally and vertically collapsible scissor lift is steerable and the plurality of wheels may be coupled such that they each rotate about a vertical axis synchronously with respect to one another to steer the lift. Further, at least one of the wheels may be self-driving to controllably propel the horizontally and vertically collapsible scissor lift. One or more winches with associated cables may be used to selectively raise and lower the vertically collapsible frame.

20 Claims, 13 Drawing Sheets

(56) References Cited

U.S. PATENT DOCUMENTS

| | | | | | |
|---|---|---|---|---|---|
| 3,212,605 | A * | 10/1965 | Dickerson | E04G 1/34 | 182/119 |
| 3,354,596 | A * | 11/1967 | Schafer | E04G 1/34 | 52/646 |
| 3,373,844 | A | 3/1968 | Schafer | | |
| 3,807,120 | A * | 4/1974 | Viandon | E04G 1/22 | 52/638 |
| 4,113,065 | A | 9/1978 | Sikli | | |
| 4,917,217 | A * | 4/1990 | Rogers | E04G 1/34 | 182/152 |
| 8,066,294 | B2 | 11/2011 | Tsai | | |
| 8,522,922 | B1 | 9/2013 | Stokes | | |
| 9,840,837 | B1 * | 12/2017 | Matsuoka | E04B 1/19 | |
| 10,167,181 | B2 * | 1/2019 | Xu | B66F 11/042 | |
| 10,267,031 | B2 * | 4/2019 | Matsuoka | A63H 33/00 | |
| 10,322,920 | B2 * | 6/2019 | Shi | B66F 11/042 | |
| D859,773 | S | 9/2019 | Beamish et al. | | |
| 2016/0115006 | A1 | 4/2016 | Presti | | |
| 2017/0283229 | A1 | 10/2017 | Shi | | |
| 2018/0119432 | A1 * | 5/2018 | Finlay | E04G 5/14 | |
| 2019/0119090 | A1 | 4/2019 | Maisonnette et al. | | |
| 2019/0166793 | A1 | 6/2019 | Flannery et al. | | |

FOREIGN PATENT DOCUMENTS

| | | | | |
|---|---|---|---|---|
| EP | 3192942 | B1 * | 9/2018 | E04G 5/147 |
| FR | 849008 | A * | 11/1939 | B66F 11/042 |
| FR | 2700350 | A1 * | 7/1994 | E04G 1/24 |
| FR | 2901295 | A1 | 11/2007 | |
| GB | 2443487 | A * | 5/2008 | E04G 1/34 |

* cited by examiner

SCISSOR-LIFT

BACKGROUND

1. Field

The disclosure of the present patent application relates to aerial platforms, and particularly to a scissor lift that is collapsible in both the horizontal and vertical directions and may be self-propelled in all directions.

2. Description of the Related Art

Aerial work platforms, such as conventional scissor lifts and the like, are machines intended to enable one or more persons to work at a selected height. For this purpose, such machines typically include a work platform designed to receive one or more persons, and optionally, heavy loads, such as tools or other equipment, as well as materials, such as paint, cement, etc. The platform typically includes a deck surrounded by a guardrail. The platform is supported by a lifting mechanism that makes it possible to raise it from a lowered position on the chassis of the work platform to a required working position at a desired height.

A great variety of aerial work platforms are available for dealing with different applications. Scissor lifts are a fairly common type of aerial work platform, in which the platform is supported in a vertically collapsible frame formed from scissor linkages. Although the vertically collapsible frame can be completely collapsed for transport of the scissor lift, the base on which the vertically collapsible frame rests, the platform, and the guardrail around the platform are typically made from rigid components, thus maintaining the horizontal length and width of the scissor lift, even when it is in its collapsed state. For purposes of storage and transport, it would obviously be desirable to be able to further collapse the scissor lift in the horizontal direction.

Thus, a scissor-lift solving the aforementioned problems is desired.

SUMMARY

The scissor lift includes a horizontally collapsible base, a vertically collapsible frame mounted on the base, a horizontally foldable platform mounted on top of the vertically collapsible frame, and a plurality of wheels mounted on the base. The base includes a first lower side support having first and second opposed side surfaces and opposed top and bottom surfaces, and a second lower side support, also having first and second opposed side surfaces and opposed top and bottom surfaces. The base further includes a lower central support and first and second lower horizontal scissor linkages. The first lower horizontal scissor linkage includes first and second linkage members pivotally attached to one another. First ends of the first and second linkage members are slidably mounted on the first side surface of the first lower side support, and the second ends of the first and second linkage members are slidably mounted on the lower central support. The second lower horizontal scissor linkage includes third and fourth linkage members pivotally attached to one another. First ends of the third and fourth linkage members are slidably mounted on the first side surface of the second lower side support, and the second ends of the third and fourth linkage members are slidably mounted on the lower central support.

The vertically collapsible frame includes a first upper side support having first and second opposed side surfaces and opposed top and bottom surfaces, and a second upper side support having first and second opposed side surfaces and opposed top and bottom surfaces. The vertically collapsible frame also includes a first set of vertical scissor linkages, each vertical scissor linkage of the first set of vertical scissor linkages including fifth and sixth linkage members pivotally attached to one another. Upper ends of the fifth and sixth linkage members of each vertical scissor linkage are pivotally attached to respective lower ends of the fifth and sixth linkage members of a vertically adjacent one of the vertical scissor linkages, and the lower ends of the fifth and sixth linkage members of a bottom one of the first set of vertical scissor linkages are slidably mounted on the top surface of the first lower side support. The upper ends of the fifth and sixth linkage members of a top one of the first set of vertical scissor linkages are slidably mounted on the bottom surface of the first upper side support.

The vertically collapsible frame further includes a second set of vertical scissor linkages, each vertical scissor linkage of the second set of vertical scissor linkages including seventh and eighth linkage members pivotally attached to one another. Upper ends of the seventh and eighth linkage members of each vertical scissor linkage are pivotally attached to respective lower ends of the seventh and eighth linkage members of a vertically adjacent one of the vertical scissor linkages, and the lower ends of the seventh and eighth linkage members of a bottom one of the second set of vertical scissor linkages are slidably mounted on the top surface of the second lower side support. The upper ends of the seventh and eighth linkage members of a top one of the second set of vertical scissor linkages are slidably mounted on the bottom surface of the second upper side support.

The vertically collapsible frame further includes an upper central support and a first upper horizontal scissor linkage including ninth and tenth linkage members pivotally attached to one another. First ends of the ninth and tenth linkage members are slidably mounted on the first side surface of the first upper side support, and the second ends of the ninth and tenth linkage members are slidably mounted on the upper central support. The vertically collapsible frame also includes a second upper horizontal scissor linkage including eleventh and twelfth linkage members pivotally attached to one another. First ends of the eleventh and twelfth linkage members are slidably mounted on the first side surface of the second upper side support, and the second ends of the eleventh and twelfth linkage members are slidably mounted on the upper central support.

The folding platform is mounted on the first and second upper side supports and the upper central support. A first set of wheels is rotationally mounted to the bottom surface of the first lower side support, and a second set of wheels is rotationally mounted to the bottom surface of the second lower side support.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
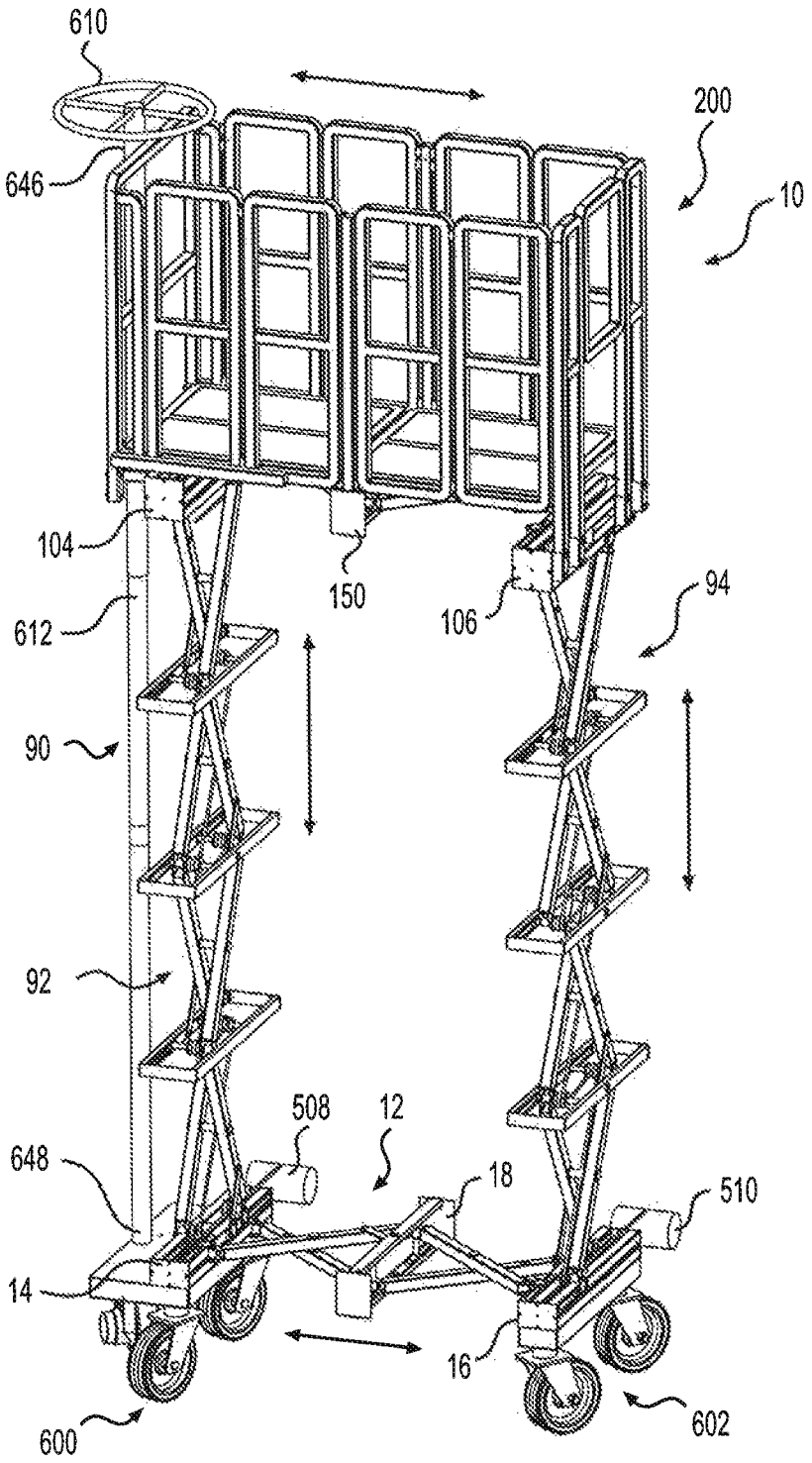
FIG. 1 is a perspective view of a scissor lift in a fully deployed configuration.
Figure 2:
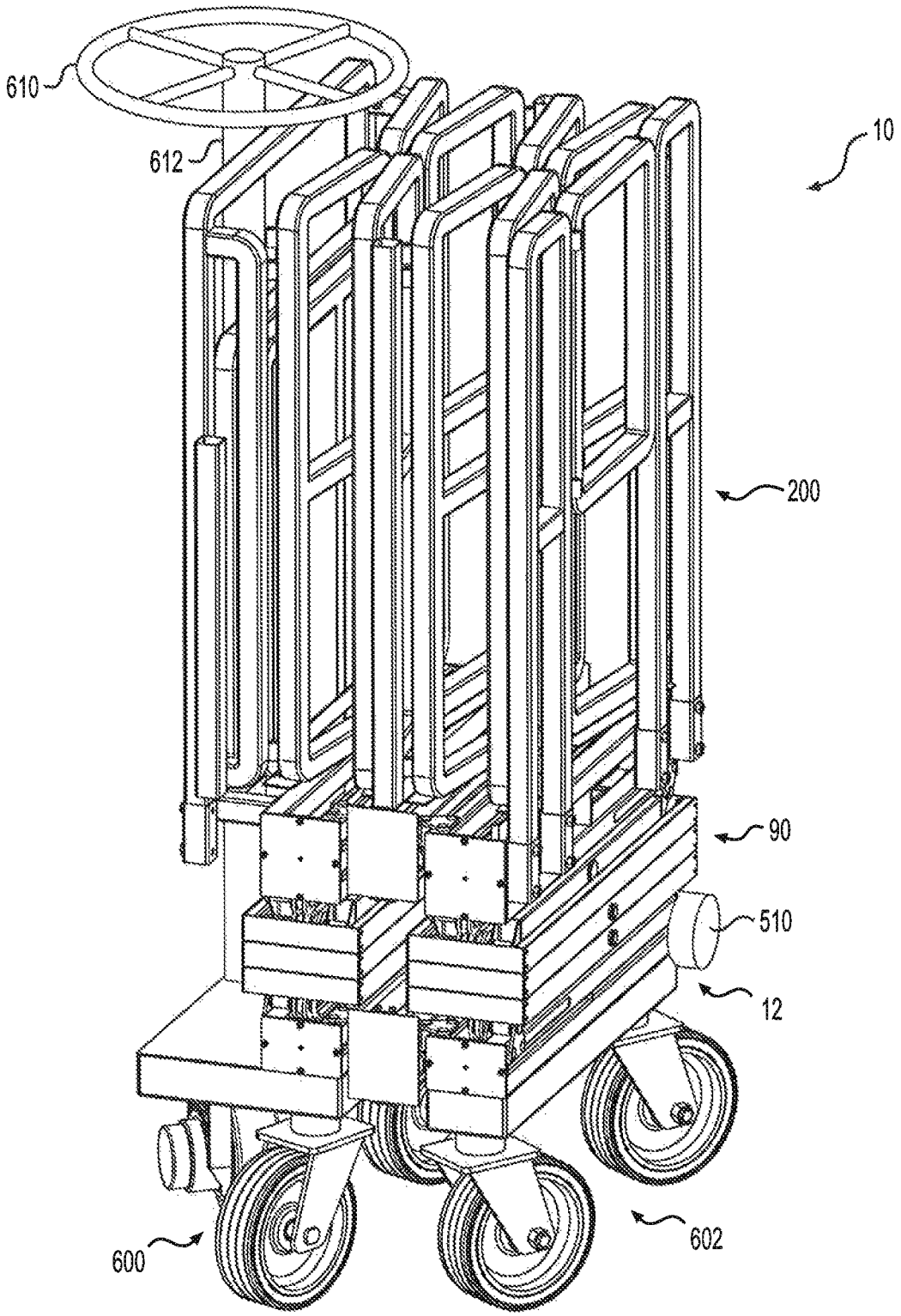
FIG. 2 is a perspective view of the scissor lift of FIG. 1 in a fully collapsed configuration.
Figure 3:
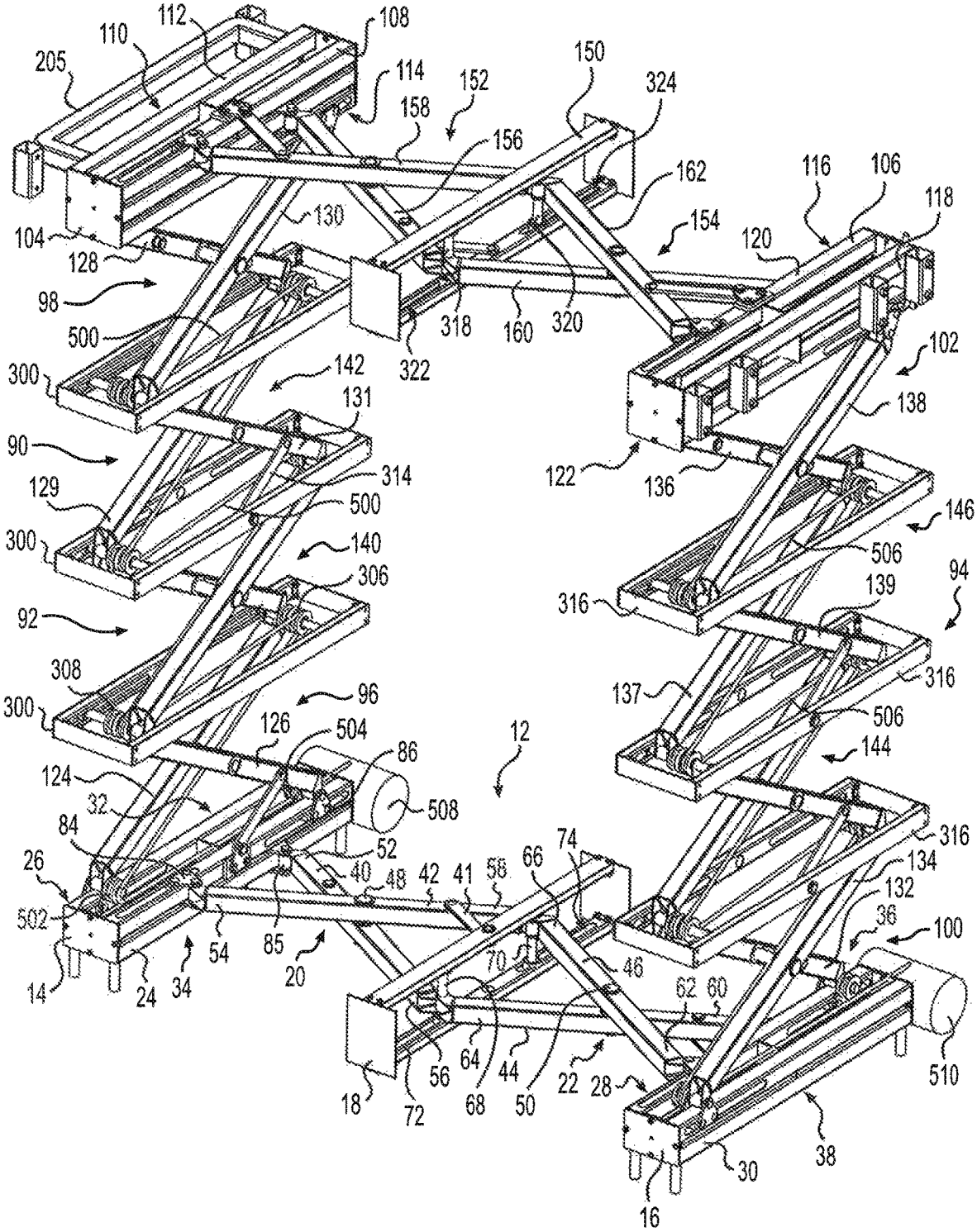
FIG. 3 is a perspective view of a frame structure of the scissor lift of FIG. 1.

Referring to FIGS. 1 and 2, the scissor lift 10 includes a horizontally collapsible base 12, a vertically collapsible frame 90 mounted on the base 12, a horizontally foldable platform 200 mounted on top of the vertically collapsible frame 90, and a plurality of wheels 600, 602 mounted on the base 12. As best shown in FIG. 3, the base 12 includes a first lower side support 14 having first and second opposed side surfaces 24, 26, respectively, and opposed top and bottom surfaces 32, 34, respectively, and a second lower side support 16, also having first and second opposed side surfaces 28, 30, respectively, and opposed top and bottom surfaces 36, 38, respectively. The base 12 further includes a lower central support 18 and first and second lower horizontal scissor linkages 20, 22, respectively.

The first lower horizontal scissor linkage 20 includes first and second linkage members 40, 42 pivotally attached to one another by a pivot pin 48 or the like. Respective first ends 52, 54 of the first and second linkage members 40, 42 are slidably mounted on the first side surface 24 of the first lower side support 14, and respective second ends 56, 58 of the first and second linkage members 40, 42 are slidably mounted on the lower central support 18. As shown, a jib link 41 may be pivotally attached to and extend between the second linkage member 42 and the lower central support 18 to provide stability to the first lower horizontal scissor linkage 20. Similar to first lower horizontal scissor linkage 20, the second lower horizontal scissor linkage 22 includes third and fourth linkage members 44, 46, respectively, pivotally attached to one another by a pivot pin 50 or the like. Respective first ends 60, 62 of the third and fourth linkage members 44, 46 are slidably mounted on the first side surface 28 of the second lower side support 16, and respective second ends 64, 66 of the third and fourth linkage members 44, 46 are slidably mounted on the lower central support 18.

Figure 4:
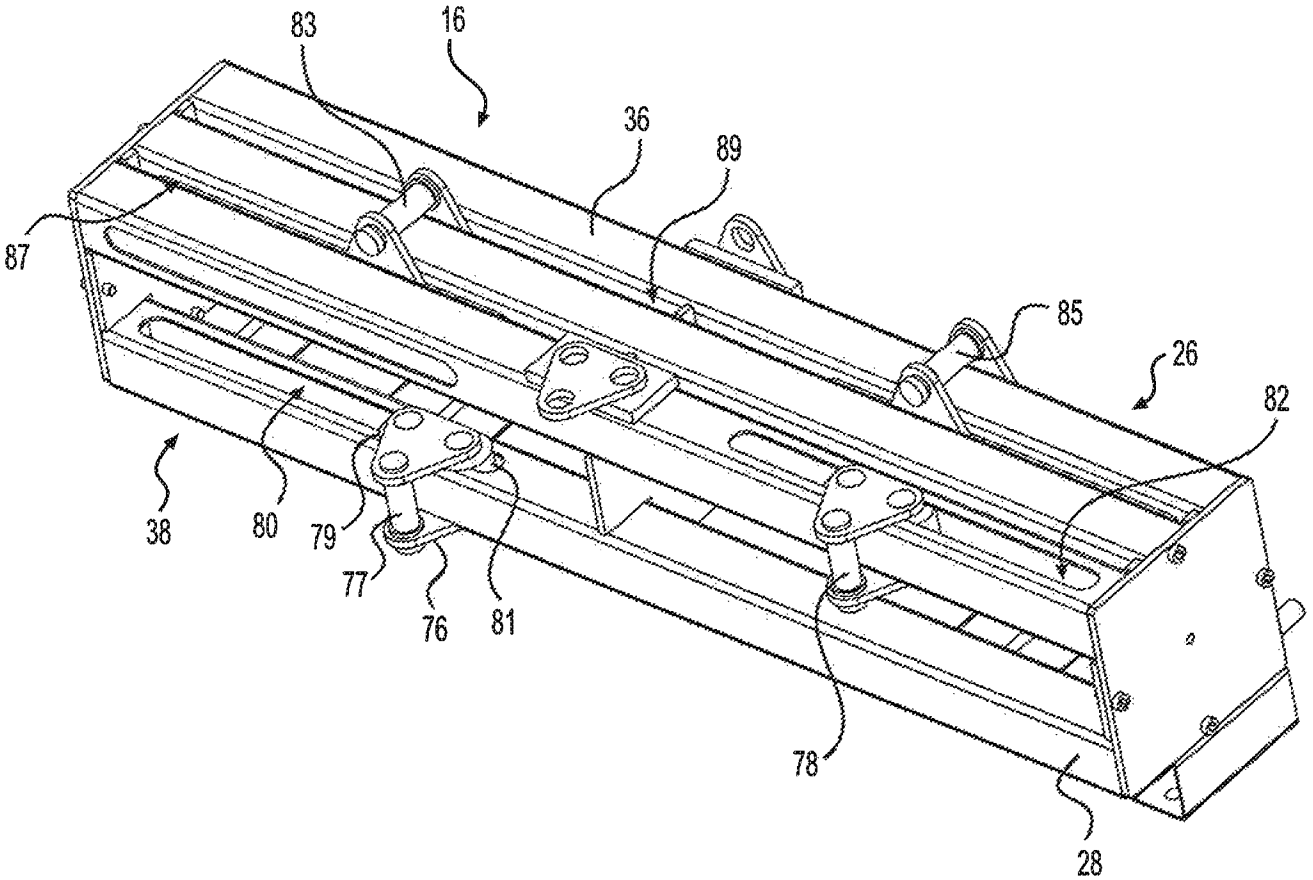
FIG. 4 is a perspective view of a lower side support of the scissor lift of FIG. 1.

The second ends 56, 58 of the first and second linkage members 40, 42, respectively, are pivotally attached to first and second lower sliding pins 68, 70, respectively, and the second ends 64, 66 of the third and fourth linkage members 44, 46, respectively, are also pivotally secured to the first and second lower sliding pins 68, 70. The first and second sliding pins 68, 70 respectively slide in first and second tracks 72, 74 defined in the lower central support 18. FIG. 4 illustrates the second lower side support 16 alone. However, it should be understood that the first lower side support 14 is symmetrically identical in construction. Third and fourth lower side sliding mounts 76, 78, respectively, are slidably mounted on the first side surface 28 of the second lower side support 16. As shown, the third lower side sliding mount 76 includes a plurality of rollers 77, 79, 81, allowing the third lower side sliding mount 76 to slide in and around a track 80. The fourth lower side sliding mount 78 is constructed in a similar manner, allowing it to slide in and around a track 82. The first ends 60, 62 of the third and fourth linkage members 44, 46, respectively, are pivotally attached to the third and fourth lower side sliding mounts 76, 78. Similarly, first and second lower side sliding mounts 85, 84, respectively, are slidably mounted on the first side surface 24 of the first lower side support 14, where the first ends 52, 54 of the first and second linkage members 40, 42 are respectively pivotally attached to the first and second lower side sliding mounts 85, 84.

Referring to FIGS. 1 and 3, the vertically collapsible frame 90 includes a first upper side support 104 having first and second opposed side surfaces 108, 110, respectively, and opposed top and bottom surfaces 112, 114, respectively, and a second upper side support 106 having first and second opposed side surfaces 116, 118, respectively, and opposed top and bottom surfaces 120, 122, respectively. The vertically collapsible frame 90 also includes a first set of vertical scissor linkages 92, where each vertical scissor linkage of the first set of vertical scissor linkages includes fifth and sixth linkage members 129, 131, respectively, pivotally attached to one another in a manner similar to that of the first and second linkage members 40, 42, and the third and fourth linkage members 44, 46. Upper ends of the fifth and sixth linkage members 129, 131 of each vertical scissor linkage are pivotally attached to respective lower ends of the fifth and sixth linkage members 129, 131 of a vertically adjacent one of the vertical scissor linkages. The lower ends of the fifth and sixth linkage members 124, 126, respectively, of a bottom one 96 of the first set of vertical scissor linkages 92 are slidably mounted on the top surface 32 of the first lower side support 14. The upper ends of the fifth and sixth linkage members 128, 130, respectively, of a top one 98 of the first set of vertical scissor linkages 92 are slidably mounted on the bottom surface 114 of the first upper side support 104.

Figure 8:
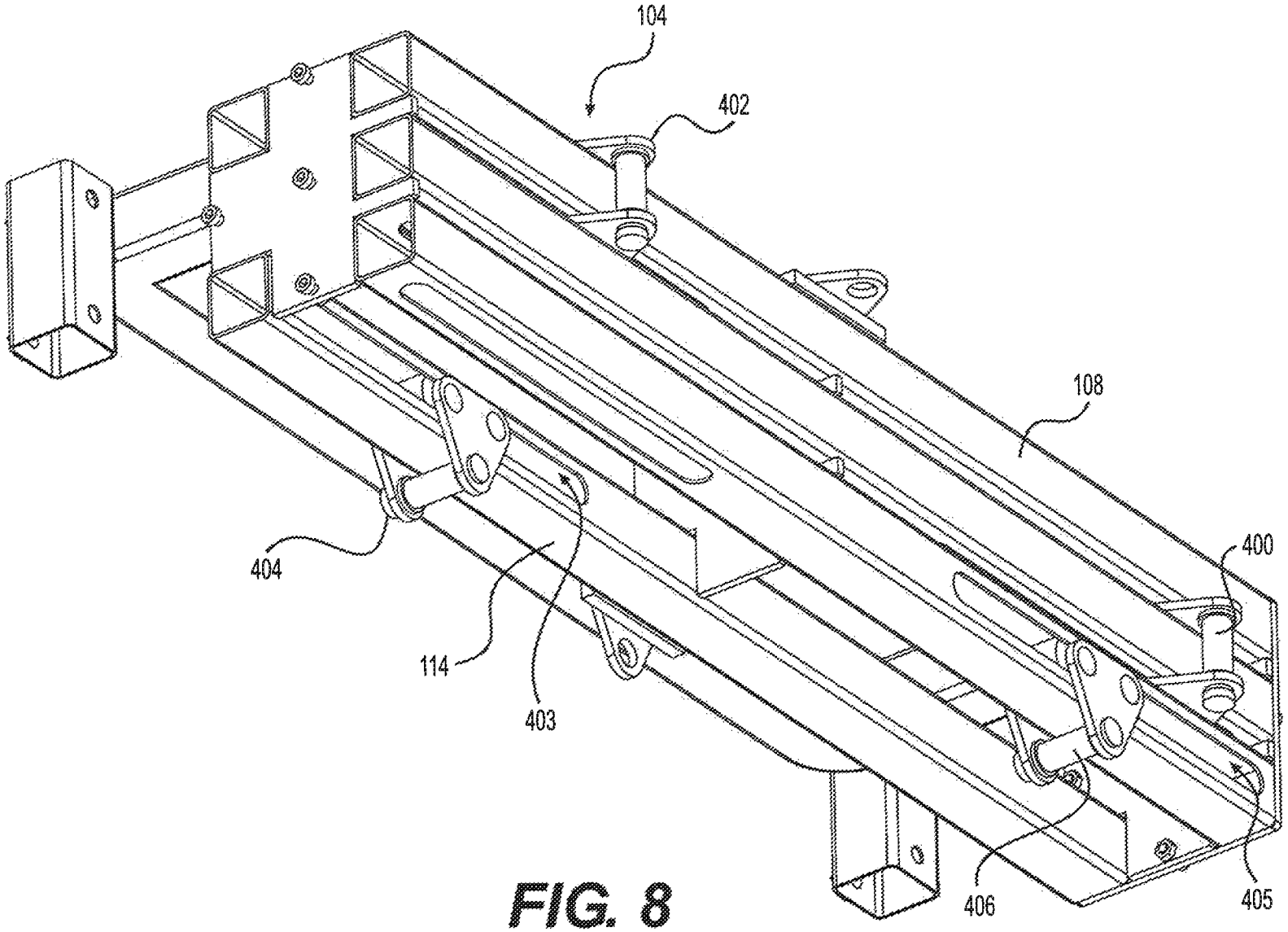
FIG. 8 is a perspective view of an upper side support of the scissor lift of FIG. 1.

Similarly, the vertically collapsible frame 90 further includes a second set of vertical scissor linkages 94, where each vertical scissor linkage of the second set of vertical scissor linkages 94 includes seventh and eighth linkage members 137, 139, respectively, also pivotally attached to one another. Upper ends of the seventh and eighth linkage members 137, 139 of each vertical scissor linkage are pivotally attached to respective lower ends of the seventh and eighth linkage members 137, 139 of a vertically adjacent one of the vertical scissor linkages of the second set of vertical scissor linkages 94, and the lower ends of the seventh and eighth linkage members 132, 134, respectively, of a bottom one 100 of the second set of vertical scissor linkages 94 are slidably mounted on the top surface 36 of the second lower side support 16. The upper ends of the seventh and eighth linkage members 136, 138, respectively, of a top one 102 of the second set of vertical scissor linkages 94 are slidably mounted on the bottom surface 122 of the second upper side support 106. Referring again to FIG. 4, the lower end of seventh linkage member 132 of the bottom one 100 of the second set of vertical scissor linkages 94 is pivotally attached to lower top sliding mount 83, which is similar in construction to third and fourth lower side sliding mounts 76, 78, as described above. Similarly, the lower end of eighth linkage member 134 of the bottom one 100 of the second set of vertical scissor linkages 94 is pivotally attached to a corresponding lower top sliding mount 85. The lower top sliding mounts 83, 85 slide in respective tracks 87, 89 formed in the top surface 36 of second lower side support 16. Similar sliding connections are used for the lower ends of fifth and sixth linkage members 84, 86 of the bottom one 96 of the first set of scissor linkages 92, as well as the upper ends of fifth and sixth linkage members 128, 130, and seventh and eighth linkage members 136, 138, which are respectively slidably and pivotally attached to the bottom surfaces 114, 122 of first and second upper side supports 104, 106. FIG. 8 illustrates the first upper side support 104 alone. However, it should be understood that second upper side support 106 is constructed symmetrically and identically and operates in a similar manner. As shown, upper bottom sliding mounts 404, 406 slide in tracks 403, 405, respectively, formed in the bottom 114 of the first upper side support 104. The upper ends of fifth and sixth linkage members 128, 130 are respectively pivotally attached thereto.

Figure 6:
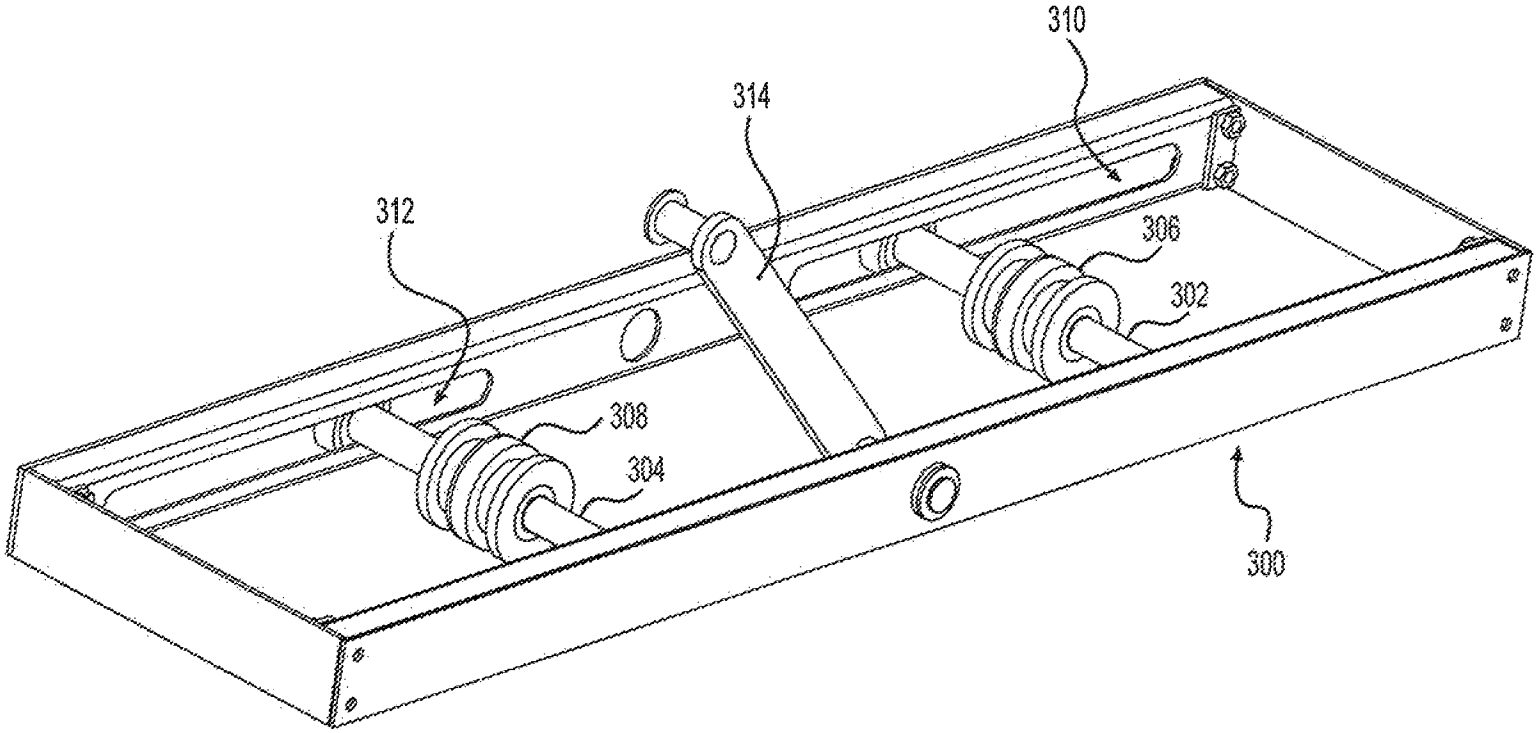
FIG. 6 is a perspective view of a support frame of the scissor lift of FIG. 1.

As shown in FIGS. 3 and 6, a plurality of first support frames 300 may be provided between each pair of scissored linkage members of the first set of vertical scissor linkages 92. First and second support rods 302, 304, respectively, are horizontally slidable within tracks 310, 312 defined in each first support frame 300. The upper ends of the fifth and sixth linkage members 129, 131, respectively, of each vertical scissor linkage of the first set of vertical scissor linkages 92 are respectively pivotally attached to the first and second support rods 302, 304 of a corresponding one of the plurality of first support frames 300. The respective lower ends of the fifth and sixth linkage members 129, 131 of a vertically adjacent one of the vertical scissor linkages are also respectively pivotally secured to the first and second support rods 302, 304. Additionally, a jib link 314 may be pivotally attached to and extend between the first support frame 300 and the corresponding sixth linkage member. Although FIG. 6 only illustrates a first support frame 300, a plurality of second support frames 316, which are symmetrically identical in construction to the first support frames 300, are also provided for the second set of vertical scissor linkages 94.

As further shown in FIG. 6, first and second pulley wheels 306, 308 are rotationally mounted on the first and second support rods 302, 304, respectively. As shown in FIG. 3, a first cable 500 may be wound about the first and second pulley wheels 306, 308 of each first support frame 300. The first cable 500 is wound between the first pulley wheel 306 of one of the first support frames 300 and the second pulley wheel 308 of a vertically adjacent one of the first support frames 300, as shown. In FIG. 3, a first winch 508 is shown mounted on the first lower side support 14 for selectively deploying and retracting the first cable 500, thus allowing the vertically collapsible frame 90 to selectively deploy and collapse. However, it should be understood that any suitable type of actuator, motor or the like may be used for deploying and retracting the first cable 500.

Figure 7:
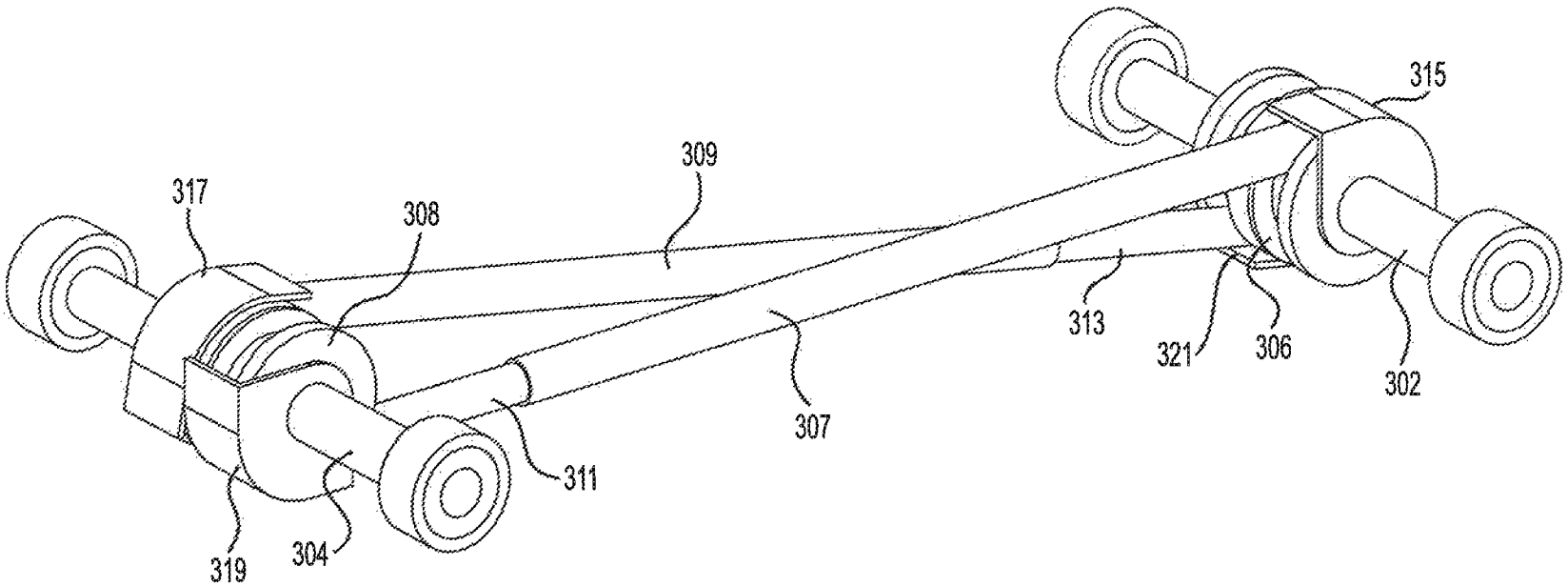
FIG. 7 is a partial perspective view of an alternative embodiment of a support frame for the scissor lift of FIG. 1.

Similar pulley wheels 502, 504 are also mounted on the top surface 32 of the first lower side support 14, and similar pulley wheels may also be provided on the bottom surface 114 of the first upper side support 104. Although a single winch 508 and single cable 500 (and associated pulley wheels) may be used to selectively deploy and collapse and the vertically collapsible frame 90, a second winch 510 (and corresponding cable 506, as well as corresponding pulley wheels on each support frame 316) may be used in a similar manner for the second set of vertical scissor linkages 94, where the second winch 510 is shown mounted on the second lower side support 16. It should be understood that the second winch-and-cable system for the second set of vertical scissor linkages 94 is constructed symmetrically and identically to that described above with regard to the first winch-and-cable system for the first set of vertical scissor linkages 92. As shown in FIG. 7, a first pair of wheel guards 315, 321 may be pivotally mounted on first support rod 302, partially shielding the first pulley wheels 306. Similarly, a second pair of wheel guards 317, 319 are pivotally mounted on second support rod 304, partially shielding the second pulley wheels 308. A small diameter tube or hollow rod 313 is attached to wheel guard 321 and is telescopically slidable within a large diameter tube or hollow rod 309, which is attached to wheel guard 317. Similarly, a small diameter tube or hollow rod 311 is attached to wheel guard 319 and is telescopically slidable within a large diameter rod 307, which is attached to wheel guard 315. The two crossed telescoping rods extend and contract as first and second support rods 302, 304 travel within tracks 310, 312, respectively. The various cables extending between the pulley wheels 306, 308 are housed within the telescoping tubes 307-313 to protect the operator of the lift from cables under tension in case of failure of a cable. The telescoping tubes 307, 309, 311, and 313 are omitted in FIG. 3 to show routing of the cable system, but it will be understood that the telescoping tubes 307-313 are a desirable safety feature of the apparatus.

As shown in FIG. 3, the vertically collapsible frame 90 further includes an upper central support 150 and a first upper horizontal scissor linkage 152 including ninth and tenth linkage members 156, 158, respectively, pivotally attached to one another. Respective first ends of the ninth and tenth linkage members 156, 158 are slidably mounted on the first side surface 108 of the first upper side support 104, and respective second ends of the ninth and tenth linkage members 156, 158 are slidably mounted on the upper central support 150. The vertically collapsible frame 90 also includes a second upper horizontal scissor linkage 154 including eleventh and twelfth linkage members 160, 162, respectively, pivotally attached to one another. Respective first ends of the eleventh and twelfth linkage members 160, 162 are slidably mounted on the first side surface 116 of the second upper side support 106, and respective second ends of the eleventh and twelfth linkage members 160, 162 are slidably mounted on the upper central support 150.

Similar to that described above with regard to base 12, the second ends of the ninth and tenth linkage members 156, 158 are pivotally attached to first and second upper sliding pins 318, 320, respectively, and the second ends of the eleventh and twelfth linkage members 160, 162 are also pivotally attached to the first and second upper sliding pins 318, 320, respectively. The first and second sliding pins 318, 320 slide in first and second tracks 322, 324, respectively, defined in the upper central support 150.

Referring again to FIG. 8, first and second upper side sliding mounts 400, 402, respectively, are slidably mounted on the first side surface 108 of the first upper side support 104, similar to that described above with regard to the second lower side support 16. The first ends of the ninth and tenth linkage members 156, 158 are pivotally secured to the first and second upper side sliding mounts 400, 402, respectively. Additionally, as shown in FIG. 3, a jib link 407 may be pivotally attached to and extend between the top surface 112 of the first upper side support 104 and the tenth linkage member 158 to provide support and stability for the first upper scissor linkage 152. FIG. 8 illustrates the first upper side support 104 alone. However, it should be understood that the second upper side support 106 is constructed symmetrically and identically, and operates in a similar manner, including a pair of upper side sliding mounts slidably mounted on the first side surface 116 of the second upper side support 106 for pivotal connection to the eleventh and twelfth linkage members 160, 162.

Figure 5:
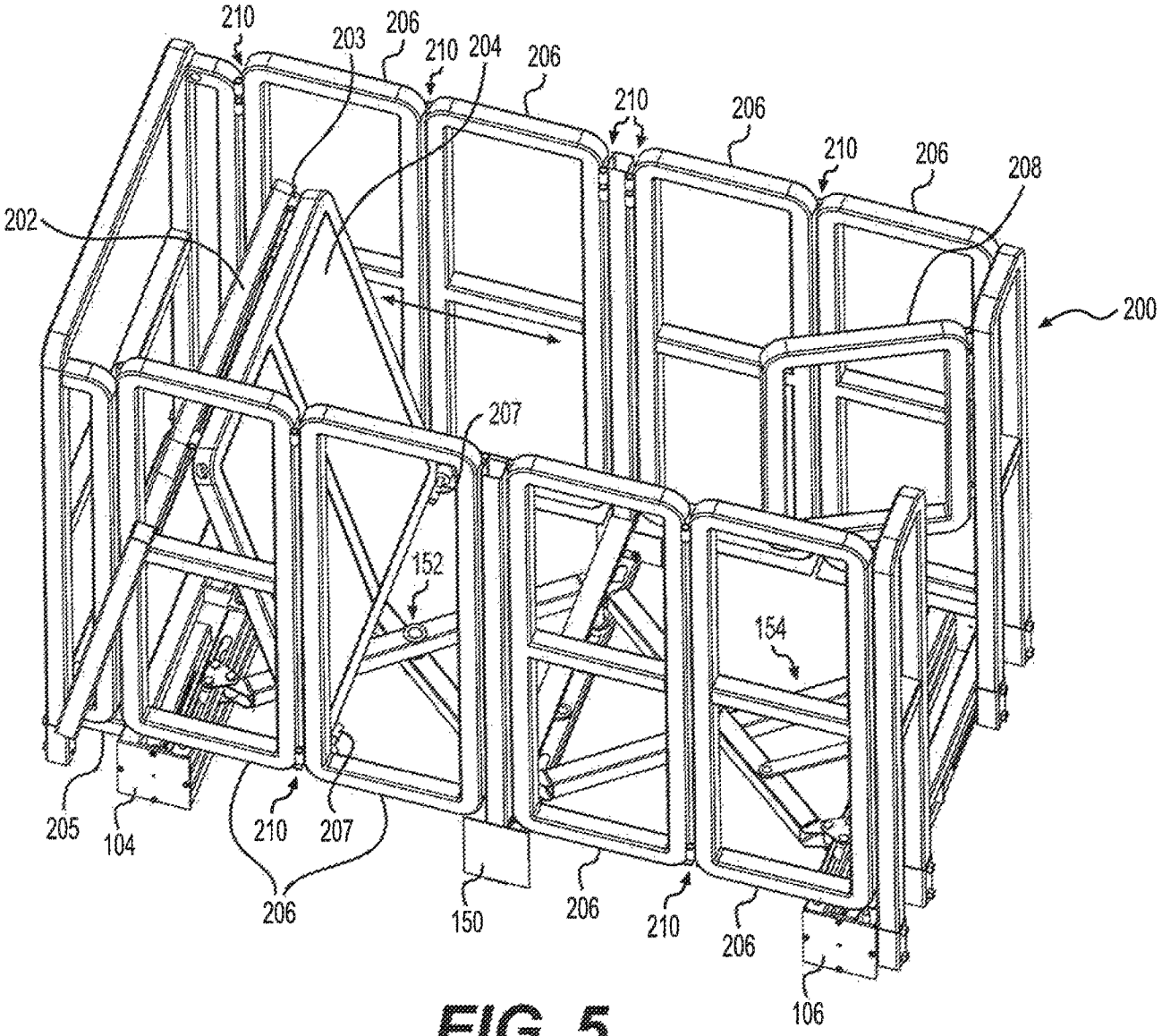
FIG. 5 is a perspective view of a collapsible platform of the scissor lift of FIG. 1.

The folding platform 200 is mounted on the first and second upper side supports 104, 106, respectively, and the upper central support 150. As shown in FIG. 5, the folding platform 200 includes first and second floor panels 202, 204, respectively, pivotally attached to one another by a hinge 203 or the like. As shown in FIG. 3, a platform mount 205 may be attached to the first upper side support 104, such that the first floor panel 202 may be pivotally attached thereto. The second floor panel 204 is horizontally slidable, including a pair of wheels 207, rollers or the like, which may move within or on tracks defined by bottom ends of a plurality of guard rail frames 206. The plurality of guard rail frames 206 are pivotally attached to one another by hinges 210 or the like. As shown in FIG. 5, one or more of the guard rail frames 206 may be replaced by a door 208.

As shown in FIG. 1, a first set of wheels 600 is rotationally mounted to the bottom surface 34 of the first lower side support 14, and a second set of wheels 602 is rotationally mounted to the bottom surface 38 of the second lower side support 16. As shown in FIG. 1, a steering wheel 610 may be provided adjacent to the platform 200. The steering wheel 610 is attached to an upper end 646 of a steering column 612, and the lower end 648 of the steering column 612 is coupled to the first set of wheels 600 for driving rotation thereof about a vertical axis. The steering column 612 may be telescopic, allowing it to be collapsed into the position shown in FIG. 2. The upper end 646 of the steering column 612 may be secured to the upper end of the guard rail so that as folding platform 200 is raised and lowered by the vertically collapsible frame 90, the steering column 612 correspondingly extends and contracts. This maintains the steering wheel 610 in the same position, with respect to the folding platform 200, whether the scissor lift 10 is in the fully deployed position of FIG. 1 or the fully collapsed position of FIG. 2. In either position, and in positions between these two configurations, the steering column 612 is rotatable to steer the sets of wheels 600 and 602. It should be noted that steering column 612 is preferably a multi-section telescopic tube, allowing its height to be varied as folding platform 200 raises and lowers, thus maintaining and preserving control by the operator at any height.

Figure 9:
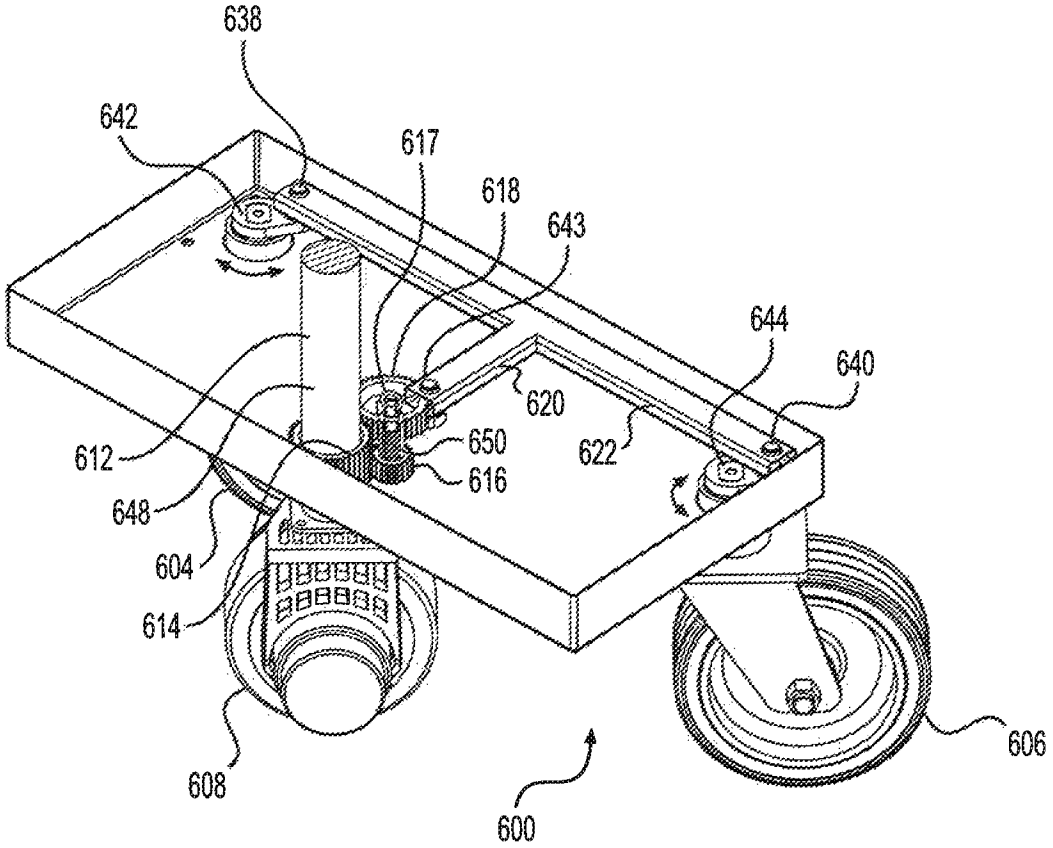
FIG. 9 is a perspective view of a first wheel assembly of the scissor lift of FIG. 1.

As shown in FIG. 9, the first set of wheels 600 rotates about the vertical axis synchronously, and may include a combination of conventional wheels 606, which may be castor wheels or the like, and at least one self-driven wheel 608. Cranks 642, 644 each correspond to one of the conventional wheels 606 and are turned, parallel and in tandem with respect to one another, in coordination with crank 643. This is performed through the rigid linkage between a first bar 620 and a perpendicularly extending the second bar 622. Cranks 642, 644 are respectively pivotally secured to the ends 638, 640 of the second bar 622. Gear 618 is rigidly attached to crank joint 643, and gear 614, which is identical in diameter to gear 618 but taller, is rigidly attached to the lower end 648 of the steering column 612. A relatively small transition gear 616 remains permanently meshed with gear 614, and can be raised out (so it is selectively out of contact with gear 618) by a ring 617, which can be attached to a separate cable. Thus, gear 616 acts as a clutch, since it can be pulled upward, selectively disengaging from gear 618, while always remaining meshed with gear 614. Releasing upward force pulling on ring 617 results in gear 616 re-engaging gear 618 due to a downward elastic force caused by a retrieve spring 650.

Figure 10:
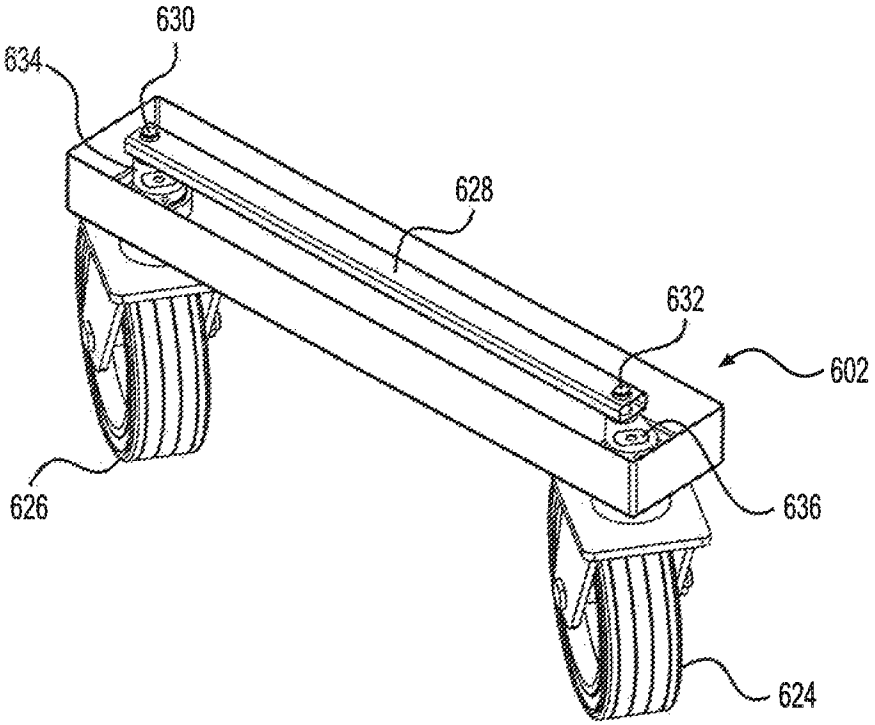
FIG. 10 is a perspective view of a second wheel assembly of the scissor lift of FIG. 1.

When all gears are engaged, turning the steering column 612 will cause gear 614 to rotate, and this rotation is transmitted through crank joint 643 simultaneously to cranks 642, 644 (through bars 620, 622), causing synchronized and parallel turning of wheels 606. As shown in FIG. 10, the second set of wheels 602, which includes two conventional wheels 624, 626, which may be castors or the like, is not directly coupled to the steering system, but includes a similar parallel-tandem linkage to cause wheels 624, 626 to rotate about the vertical axis in a parallel synchronized manner. The ends 630, 632 of bar 628 are respectively pivotally attached to cranks 634, 636, which cause wheels 624, 626 to rotate synchronously.

Figure 11:
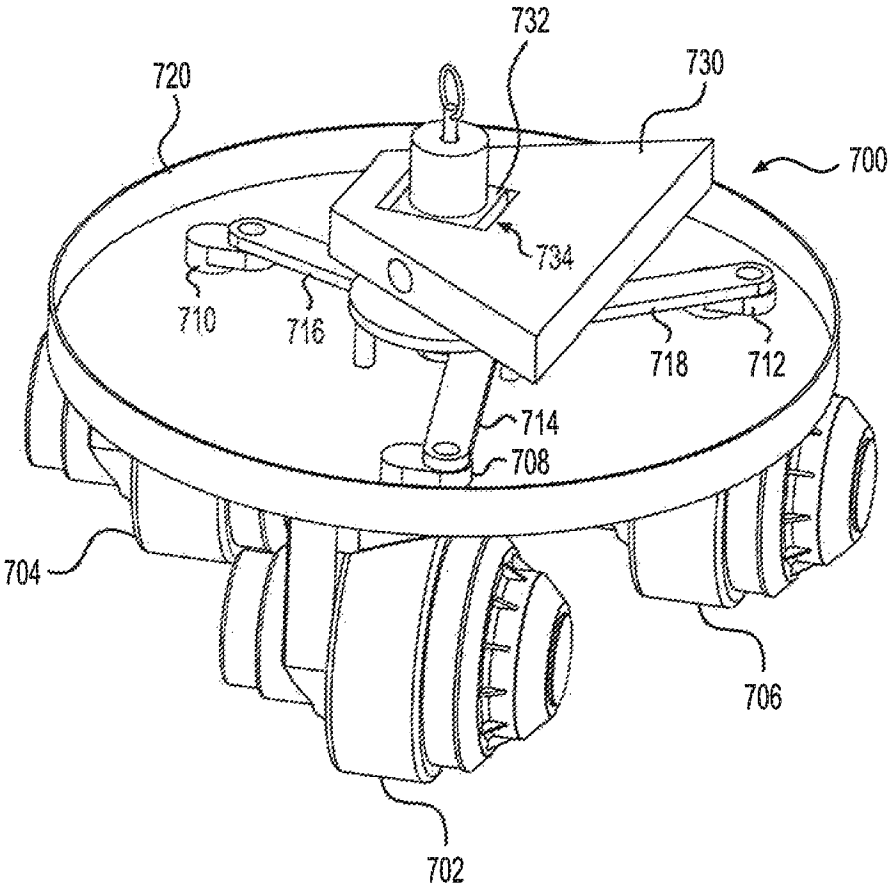
FIG. 11 is a perspective view of an alternative embodiment of a first wheel assembly for the scissor lift of FIG. 1.
Figure 12:
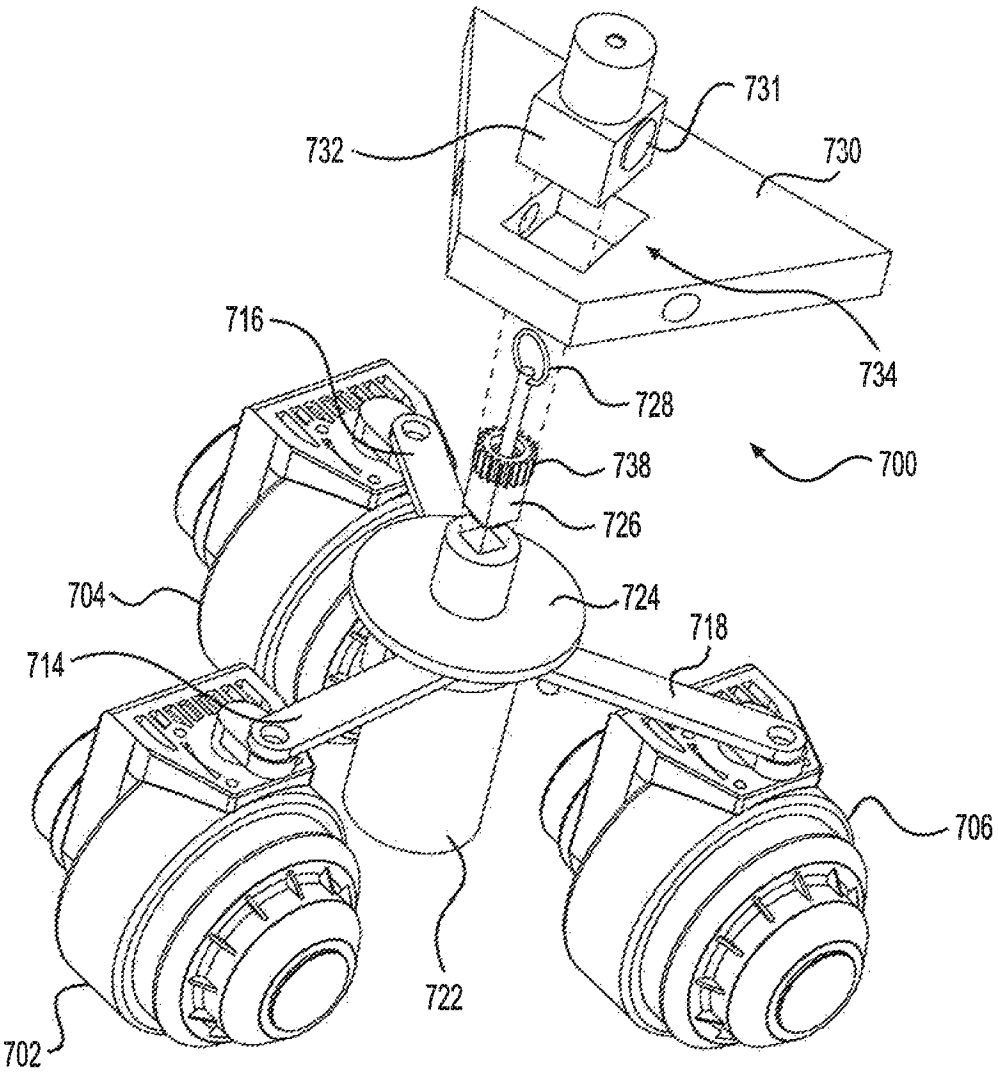
FIG. 12 is a partially exploded perspective view of the wheel assembly of FIG. 11.
Figure 13:
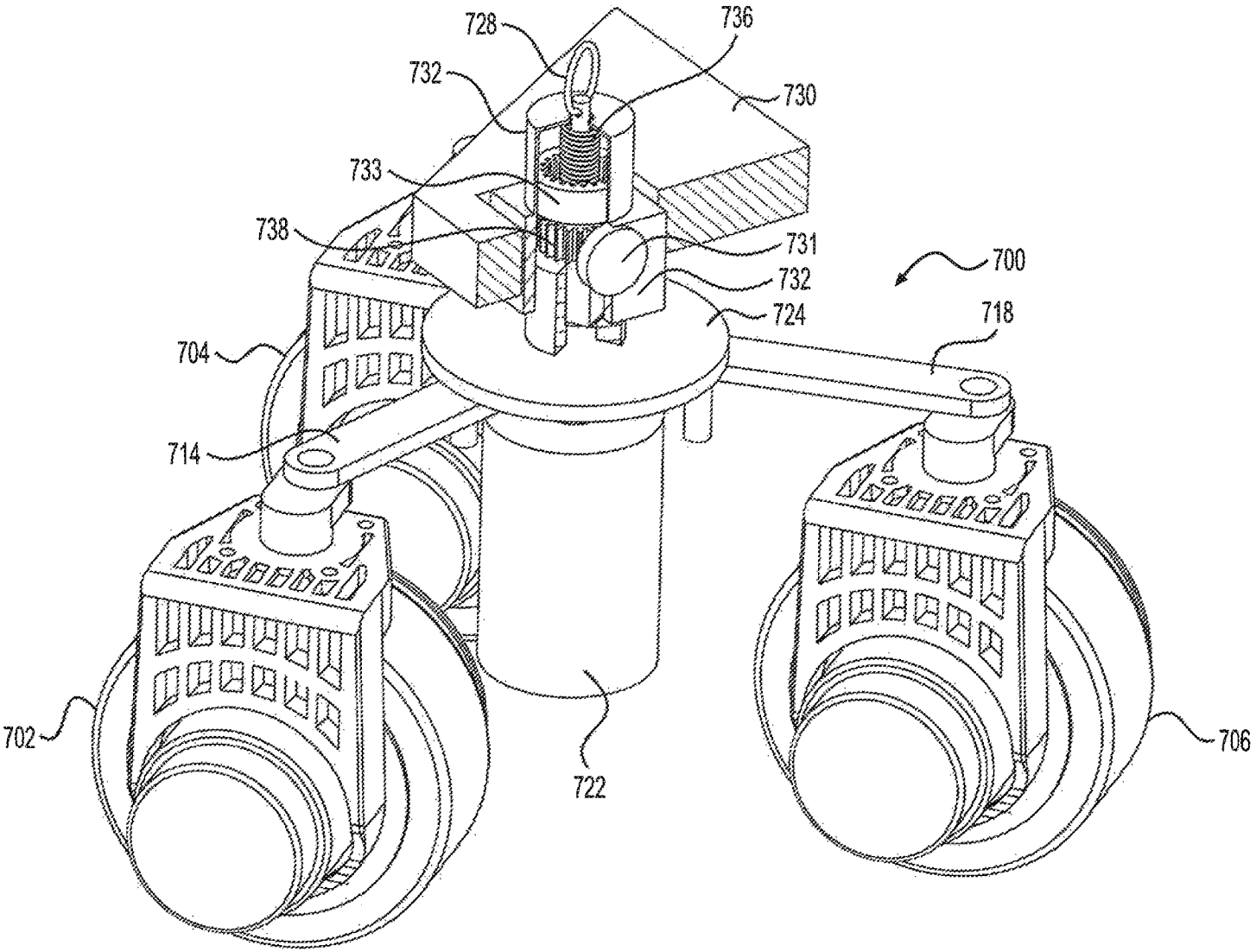
FIG. 13 is a perspective view of the wheel assembly of FIG. 11, partially broken away and in section.

In the alternative embodiment of FIGS. 11-13, the first set of wheels 600 is replaced by a wheel assembly 700. In this embodiment, each of wheels 702, 704, 706 is a self-driven wheel. A supporting plate 730 is secured to the first lower side support 14 and has a square opening 734 formed therethrough. A cubic head 732 is disposed within opening 734, but is free to swing within the opening 734. The cubic head 732 is pivotally mounted to supporting plate 730 by a swing pin 731, providing the cubic head 732 with swing freedom within opening 734 of the supporting plate 730.

As shown in FIG. 13, the cubic head 732 has a circular internal gear 733, which serves as a coupler that can be selectively meshed with gear 738, serving as a clutch. Similar to the previous embodiment, a pull ring 728, which is resiliently biased by a spring 736, is coupled to the circular internal gear 733. Thus, when pull ring 728 is pulled upward by an attached cable or the like, the circular internal gear 733 can be selectively disengaged from the relatively small pinion gear 738, which is mounted on a block 726. Block 726 is rigidly mounted on a center head 724.

For purposes of clarity, in FIGS. 12 and 13, the mounting plate 720 has been removed. The center head 724 is pivotally coupled to self-driving wheels 702, 704, 706 by respective bars 714, 716, 718, each attached by a respective crank joint 708, 710, 712 to the corresponding one of wheels 702, 704, 706. A power motor 722 is used to control steering for the wheels 702, 704, 706, which each turn in parallel and synchronously due to their linked connection with center head 724 via bars 714, 716, 718 and the respective crank joints 708, 710, 712. When the circular internal gear 733 is pulled up to disengage from pinion gear 738, the center head 724 (and the wheels 702, 704, 706) is free to rotate. However, when circular intern gear 733 is lowered to engage with pinion gear 738, the center head 724 is locked in place with respect to supporting plate 730 (which is fixed to the first lower side support 14).

It is to be understood that the scissor-lift is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A scissor lift, comprising:

a base, including:

a first lower side support having first and second opposed side surfaces and opposed top and bottom surfaces;

a second lower side support having first and second opposed side surfaces and opposed top and bottom surfaces;

a lower central support;

a first lower horizontal scissor linkage having first and second linkage members pivotally attached to one another, the first and second linkage members each having first ends slidably mounted on the first side surface of the first lower side support, and having second ends slidably mounted on the lower central support; and a second lower horizontal scissor linkage having third and fourth linkage members pivotally attached to one another, the third and fourth linkage members each having first ends slidably mounted on the first side surface of the second lower side support, and second ends slidably mounted on the lower central support;

a vertically collapsible frame, including:

a first upper side support having first and second opposed side surfaces and opposed top and bottom surfaces;

a second upper side support having first and second opposed side surfaces and opposed top and bottom surfaces;

a first set of vertical scissor linkages, each of the vertical scissor linkages of the first set of vertical scissor linkages including fifth and sixth linkage members pivotally attached to one another by a center pivot, the fifth and sixth linkage members having an upper end and a lower end, the upper ends of one of the vertical scissor linkages being pivotally attached to the lower ends of a vertically adjacent vertical scissor linkage, the first set including a bottom vertical scissor linkage and a top vertical scissor linkage, the lower ends of the fifth and sixth linkage members of the bottom vertical scissor linkage being slidably mounted on the top surface of the first lower side support, the upper ends of the fifth and sixth linkage members of the top vertical scissor linkage being slidably mounted on the bottom surface of the first upper side support;

a second set of vertical scissor linkages, each of the vertical scissor linkages of the second set of vertical scissor linkages including seventh and eighth linkage members pivotally attached to one another by a center pivot, the seventh and eighth linkage members each having an upper end and a lower end, the upper ends of one of the vertical scissor linkages being pivotally attached to the lower ends of a vertically adjacent vertical scissor linkage, the second set including a bottom vertical scissor linkage and a top vertical scissor linkage, the lower ends of the seventh and eighth linkage members of the bottom vertical scissor linkage being slidably mounted on the top surface of the second lower side support, the upper ends of the seventh and eighth linkage members of the top vertical scissor linkage being slidably mounted on the bottom surface of the second upper side support;

an upper central support;

a first upper horizontal scissor linkage including ninth and tenth linkage members pivotally secured to one another by a center pivot, the ninth and tenth linkage members each having a first end and a second end, the first ends being slidably mounted on the first side surface of the first upper side support, and the second ends of the ninth and tenth linkage members being slidably mounted on the upper central support; and a second upper horizontal scissor linkage including eleventh and twelfth linkage members pivotally secured to one another by a center pivot, the eleventh and twelfth linkage members each having a first end and a second end, the first ends of the eleventh and twelfth linkage members being slidably mounted on the first side surface of the second upper side support, and the second ends of the eleventh and twelfth linkage members being slidably mounted on the upper central support;

a folding platform mounted on the first and second upper side supports and the upper central support;

a first set of wheels rotationally mounted on the bottom surface of the first lower side support; and a second set of wheels rotationally mounted on the bottom surface of the second lower side support.

2. The scissor lift as recited in claim 1, wherein the lower central support has first and second tracks defined therein, the scissor lift further comprising first and second sliding pins slidable in the first and second tracks, respectively, the second ends of the first and third linkage members being pivotally attached to the first sliding pin, the second ends of the second and fourth linkage members being pivotally attached to the second sliding pin.

3. The scissor lift as recited in claim 2, further comprising:

first and second lower side sliding mounts slidably mounted on the first side surface of the first lower side support, the first ends of the first and second linkage members being pivotally attached to the first and second lower side sliding mounts, respectively; and third and fourth lower side sliding mounts slidably mounted on the first side surface of the second lower side support, the first ends of the third and fourth linkage members being pivotally attached to the third and fourth lower side sliding mounts, respectively.

4. The scissor lift as recited in claim 1, further comprising:

a plurality of first support frames having tracks defined therein and first and second support rods horizontally slidable within the tracks, and the upper ends of the fifth and sixth linkage members of each said vertical scissor linkage of the first set of vertical scissor linkages being pivotally attached to the first and second support rods, respectively, of a corresponding one of the plurality of first support frames, the lower ends of the fifth and sixth linkage members of a vertically adjacent one of the vertical scissor linkages being pivotally attached to the first and second support rods, respectively, of the corresponding one of the plurality of first support frames; and a plurality of second support frames having tracks defined therein and first and second support rods horizontally slidable within the tracks, the upper ends of the seventh and eighth linkage members of each said vertical scissor linkage of the second set of vertical scissor linkages being pivotally attached to the first and second support rods, respectively, of a corresponding one of the plurality of second support frames, the lower ends of the seventh and eighth linkage members of a vertically adjacent one of the vertical scissor linkages being pivotally attached to the first and second support rods, respectively, of the corresponding one of the plurality of second support frames.

5. The scissor lift as recited in claim 4, wherein each said first support frame further comprises first and second pulley wheels rotationally mounted on the first and second support rods, respectively.

6. The scissor lift as recited in claim 5, further comprising a first cable wound about the first and second pulley wheels of each said first support frame, the first cable further being wound between the first pulley wheel of one of said first support frames and the second pulley wheel of an adjacent one of said first support frames.

7. The scissor lift as recited in claim 6, further comprising a first winch mounted on the first lower side support, the first cable being attached to the first winch for selectively deploying and retracting the first cable.

8. The scissor lift as recited in claim 7, wherein each said second support frame further comprises first and second pulley wheels rotationally mounted on the first and second support rods, respectively, of the second support frame.

9. The scissor lift as recited in claim 8, further comprising a second cable wound about the first and second pulley wheels of each said second support frame, the second cable further being wound between the first pulley wheel of one of said second support frames and the second pulley wheel of an adjacent one of said second support frames.

10. The scissor lift as recited in claim 9, further comprising a second winch mounted on the second lower side support, the second cable being attached to the second winch for selectively deploying and retracting the second cable.

11. The scissor lift as recited in claim 1, wherein the upper central support has first and second tracks defined therein, the scissor lift further comprising first and second upper sliding pins slidable in the first and second tracks, respectively of the upper central support, the second ends of the ninth and tenth linkage members being pivotally attached to the first and second upper sliding pins, respectively, the second ends of the eleventh and twelfth linkage members being pivotally attached to the first and second upper sliding pins, respectively.

12. The scissor lift as recited in claim 11, further comprising:

first and second upper side sliding mounts slidably mounted on the first side surface of the first upper side support, the first ends of the ninth and tenth linkage members being pivotally attached to the first and second upper side sliding mounts, respectively; and third and fourth upper side sliding mounts slidably mounted on the first side surface of the second upper side support, the first ends of the eleventh and twelfth linkage members being pivotally attached to the third and fourth lower side sliding mounts, respectively.

13. The scissor lift as recited in claim 1, further comprising:

a steering wheel; and a steering column having opposed upper and lower ends, the steering wheel being attached to the upper end of the steering column, the lower end of the steering column being coupled to the first set of wheels for driving rotation thereof about a vertical axis.

14. The scissor lift as recited in claim 13, wherein the first set of wheels rotate about the vertical axis synchronously.

15. The scissor lift as recited in claim 14, wherein the first set of wheels comprises at least one self-driven wheel.

16. The scissor lift as recited in claim 13, wherein the second set of wheels rotates about the vertical axis synchronously.

17. The scissor lift as recited in claim 1, wherein the folding platform comprises first and second floor panels pivotally attached to one another, the first floor panel being pivotally mounted on the first upper side support, the second floor panel being horizontally slidable.

18. The scissor lift as recited in claim 17, wherein the folding platform further comprises a plurality of guard rail frames pivotally attached to one another.

19. The horizontally and vertically collapsible scissor lift as recited in claim 17, further comprising a platform mount secured to the first upper side support, the first floor panel being pivotally attached to the platform mount.

20. A scissor lift, comprising:

a base, including:

a first lower side support having first and second opposed side surfaces and opposed top and bottom surfaces;

a second lower side support having first and second opposed side surfaces and opposed top and bottom surfaces;

a lower central support;

a first lower horizontal scissor linkage having first and second linkage members pivotally attached to one another, the first and second linkage members each having first ends slidably mounted on the first side surface of the first lower side support, and having second ends slidably mounted on the lower central support; and a second lower horizontal scissor linkage having third and fourth linkage members pivotally attached to one another, the third and fourth linkage members each having first ends slidably mounted on the first side surface of the second lower side support, and second ends slidably mounted on the lower central support;

a vertically collapsible frame, including:

a first upper side support having first and second opposed side surfaces and opposed top and bottom surfaces;

a second upper side support having first and second opposed side surfaces and opposed top and bottom surfaces;

a first set of vertical scissor linkages, each of the vertical scissor linkages of the first set of vertical scissor linkages including fifth and sixth linkage members pivotally attached to one another by a center pivot, the fifth and sixth linkage members having an upper end and a lower end, the upper ends of one of the vertical scissor linkages being pivotally attached to the lower ends of a vertically adjacent vertical scissor linkage, the first set including a bottom vertical scissor linkage and a top vertical scissor linkage, the lower ends of the fifth and sixth linkage members of the bottom vertical scissor linkage being slidably mounted on the top surface of the first lower side support, the upper ends of the fifth and sixth linkage members of the top vertical scissor linkage being slidably mounted on the bottom surface of the first upper side support;

a second set of vertical scissor linkages, each of the vertical scissor linkages of the second set of vertical scissor linkages including seventh and eighth linkage members pivotally attached to one another by a center pivot, the seventh and eighth linkage members each having an upper end and a lower end, the upper ends of one of the vertical scissor linkages being pivotally attached to the lower ends of a vertically adjacent vertical scissor linkage, the second set including a bottom vertical scissor linkage and a top vertical scissor linkage, the lower ends of the seventh and eighth linkage members of the bottom vertical scissor linkage being slidably mounted on the top surface of the second lower side support, the upper ends of the seventh and eighth linkage members of the top vertical scissor linkage being slidably mounted on the bottom surface of the second upper side support;

an upper central support;

a first upper horizontal scissor linkage including ninth and tenth linkage members pivotally secured to one another by a center pivot, the ninth and tenth linkage members each having a first end and a second end, the first ends being slidably mounted on the first side surface of the first upper side support, and the second ends of the ninth and tenth linkage members being slidably mounted on the upper central support; and a second upper horizontal scissor linkage including eleventh and twelfth linkage members pivotally secured to one another by a center pivot, the eleventh and twelfth linkage members each having a first end and a second end, the first ends of the eleventh and twelfth linkage members being slidably mounted on the first side surface of the second upper side support, and the second ends of the eleventh and twelfth linkage members being slidably mounted on the upper central support;

a folding platform mounted on the first and second upper side supports and the upper central support;

a first set of wheels rotationally mounted on the bottom surface of the first lower side support;

a second set of wheels rotationally mounted on the bottom surface of the second lower side support;

a plurality of first support frames having tracks defined therein and first and second support rods horizontally slidable within the tracks, the first and second support rods having first and second pulley wheels rotationally mounted thereon, the upper ends of the fifth and sixth linkage members of each of the vertical scissor linkages of the first set of vertical scissor linkages being pivotally attached to the first and second support rods, respectively, of a corresponding one of the plurality of first support frames, the lower ends of the fifth and sixth linkage members of a vertically adjacent one of the vertical scissor linkages being pivotally attached to the first and second support rods, respectively, of the corresponding one of the plurality of first support frames;

a plurality of second support frames having tracks defined therein and first and second support rods horizontally slidable within the tracks, the first and second support rods of the second support frame having first and second pulley wheels rotationally mounted thereon, the upper ends of the seventh and eighth linkage members of each of the vertical scissor linkages of the second set of vertical scissor linkages being pivotally attached to the first and second support rods, respectively, of a corresponding one of the plurality of second support frames, the lower ends of the seventh and eighth linkage members of a vertically adjacent one of the vertical scissor linkages being pivotally attached to the first and second support rods, respectively, of the corresponding one of the plurality of second support frames;

a first cable wound about the first and second pulley wheels of each of the first support frames, the first cable further being wound between the first pulley wheel of one of the first support frames and the second pulley wheel of an adjacent one of the first support frames; and a second cable wound about the first and second pulley wheels of each of the second support frames, the second cable further being wound between the first pulley wheel of one of the second support frames and the second pulley wheel of an adjacent one of the second support frames.

* * * * *